US010161230B2

(12) United States Patent
Roycroft et al.

(10) Patent No.: US 10,161,230 B2
(45) Date of Patent: Dec. 25, 2018

(54) WELL PLUNGER SYSTEMS

(71) Applicant: Patriot Artificial Lift, LLC, College Station, TX (US)

(72) Inventors: Robert G. Roycroft, Houston, TX (US); Darrell W. Mitchum, Oakhurst, TX (US)

(73) Assignee: Patriot Artificial Lift, LLC, College Station, TX (US)

( * ) Notice: Subject to any disclaimer, the term of this patent is extended or adjusted under 35 U.S.C. 154(b) by 126 days.

(21) Appl. No.: 15/070,237

(22) Filed: Mar. 15, 2016

(65) Prior Publication Data

US 2017/0268318 A1 Sep. 21, 2017

(51) Int. Cl.
*E21B 43/12* (2006.01)

(52) U.S. Cl.
CPC ..... *E21B 43/121* (2013.01)

(58) Field of Classification Search
CPC ..... E21B 43/121
See application file for complete search history.

(56) References Cited

U.S. PATENT DOCUMENTS 6,148,923 A * 11/2000 Casey ..... E21B 43/121 166/329
7,322,417 B2 * 1/2008 Rytlewski ..... E21B 23/02 166/313
2005/0056416 A1 * 3/2005 Gray ..... E21B 43/121 166/68.5
2017/0058651 A1 * 3/2017 Damiano ..... E21B 43/121

* cited by examiner

*Primary Examiner* — Brad Harcourt
(74) *Attorney, Agent, or Firm* — Park, Vaughan, Fleming & Dowler LLP

(57) ABSTRACT

Embodiments of well plunger systems, assemblies, and apparatuses are described. In an embodiment, the apparatus includes a body having a first open end, a second open end, and a channel extending from the first open end through the body to the second open end, the channel for passing fluid from an oil or gas well. The apparatus may also include a receiver disposed at the first open end, the receiver configured to receive a stopper configured to at least partially seal off the channel, the first open end comprising a retention member receiver configured to receive one or more specially adapted retention members for applying a retention force to the stopper when the stopper is engaged with the receiver.

20 Claims, 6 Drawing Sheets

WELL PLUNGER SYSTEMS

FIELD

This disclosure relates generally to oil and gas well systems, and more specifically to well plunger systems.

BACKGROUND

It is well known that production from oil and gas wells can suffer due to the build-up of fluids at the bottom of the well. Various methods and devices have been developed to remove those fluids so as to improve the well's productivity. See e.g., U.S. Pat. No. 6,148,923, which is incorporated herein by reference.

One such device is known as a plunger, of which there are many variants known to those skilled in the art. For example, an auto-cycling plunger operates as follows: (1) it is dropped into the well (at the well's surface); (2) it free-falls down the well until it stops upon impact at the bottom of the well; and (3) it thereafter is caused (by pressure in the well) to travel back toward the surface of the well, pushing a "load" of liquid above it for removal at the well's surface by a lubricator assembly. The plunger then is allowed to repeat that cycle, thereby ultimately removing enough fluid from the well to improve its production.

A number of problems have arisen from the use of prior art plungers. For example, due to the typically great distance between the surface and bottom of a well, and high pressures within the well system, the plunger often travels at a great rate of speed when it is received by the lubricator at the top of the well and/or received by a bumper assembly at the bottom of the well. Impacts between the plunger and the lubricator and/or bumper assembly can be violent. They often are so violent that damage occurs (either immediately or over time due to repeated use) to the lubricator, the bumper assembly, and/or the plunger itself.

Additionally, components of the plunger may be susceptible to damage from repeated use or adverse use conditions. For example, a shuttle ball plunger may include a shuttle ball that is configured to insert into an opening in the plunger, thereby closing the plunger to fluid flow and causing the plunger to rise to the surface of the well. The fluid found in the well typically includes dirt, grime, and other debris, which can cause excess wear to surfaces interfacing between the shuttle ball and the plunger body.

Still further, some shuttle ball plungers include an o-ring retention mechanism for retaining the shuttle ball within the opening of the plunger until the plunger rises to the wellhead and the shuttle ball is ejected (against the force exerted by the o-ring) from the plunger by the lubricator system. Other shuttle ball plungers include a metal c-clip having square or rectangular edges for receiving and then holding the shuttle ball in place until the plunger reaches the lubricator. It has been discovered, however, that after repeated high energy use, these retention mechanisms either failed due to wear and/or (in the case of the metal c-clip having square edges) damaged the interior side walls of the plunger, thereby limiting the useful life of the plunger assembly in both cases.

SUMMARY

Embodiments of well plunger systems, assemblies, and apparatuses are described. In an embodiment, the apparatus includes a body having a first open end, a second open end, and a channel extending from the first open end through the body to the second open end, the channel for passing fluid and debris from an oil or gas well. The apparatus may also include a receiver disposed at the first open end, the receiver configured to receive a stopper configured to at least partially (i.e., partially or fully) seal off the first open end, the receiver comprising a retention member receiver configured to receive one or more specially adapted retention members for applying a retention force to the stopper when the stopper is engaged with the receiver.

An embodiment of a plunger assembly also may include a body having a first open end, a second open end, and a channel extending from the first open end through the body to the second open end, the channel for passing fluid and debris from an oil or gas well, a receiver disposed at the first open end, the receiver configured to receive a stopper configured to at least partially seal off the first open end, the receiver comprising a retention member receiver configured to receive a plurality of specially adapted retention members, a first retention member disposed within the retention member receiver for applying a retention force to the stopper when the stopper is engaged with the receiver, and a second retention member disposed adjacent the first retention member within the retention member receiver.

Embodiments of a system may include a well assembly comprising a well bottom, a wellhead, and a well pipe coupling the wellhead to the well bottom. The system may also include a plunger lift assembly configured to lift fluid from the well bottom to the wellhead. In an embodiment, the plunger lift assembly may include a plunger assembly having a body with a first open end, a second open end, and a channel extending from the first open end through the body to the second open end, the channel for passing fluid and debris from an oil or gas well, a receiver disposed at the first open end, the receiver configured to receive a stopper configured to at least partially seal off the first open end, the receiver comprising a retention member receiver configured to receive a one or more specially adapted retention members, a first retention member disposed within the retention member receiver for applying a retention force to the stopper when the stopper is engaged with the receiver, and an optional second retention member disposed adjacent the first retention member within the retention member receiver. The system may also include a bumper assembly disposed proximate to the well bottom and configure to catch the plunger lift assembly before reaching the well bottom, and a lubricator disposed proximate to the wellhead, the lubricator configured to eject the stopper from the plunger in response to the plunger reaching the lubricator.

DETAILED DESCRIPTION

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Various features and advantageous details are explained more fully with reference to the nonlimiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The present embodiments include a well system for oil and/or gas production. In an embodiment, the well system includes a well assembly comprising a well bottom, a wellhead, and a well pipe coupling the wellhead to the well bottom. The system may also include a plunger lift assembly configured to lift fluid from the well bottom to the wellhead. In an embodiment, the system includes a bumper assembly disposed proximate to the well bottom and configured to catch the plunger lift assembly at or before reaching the well bottom. The system may also include a lubricator disposed proximate to the wellhead.

Figure 1:
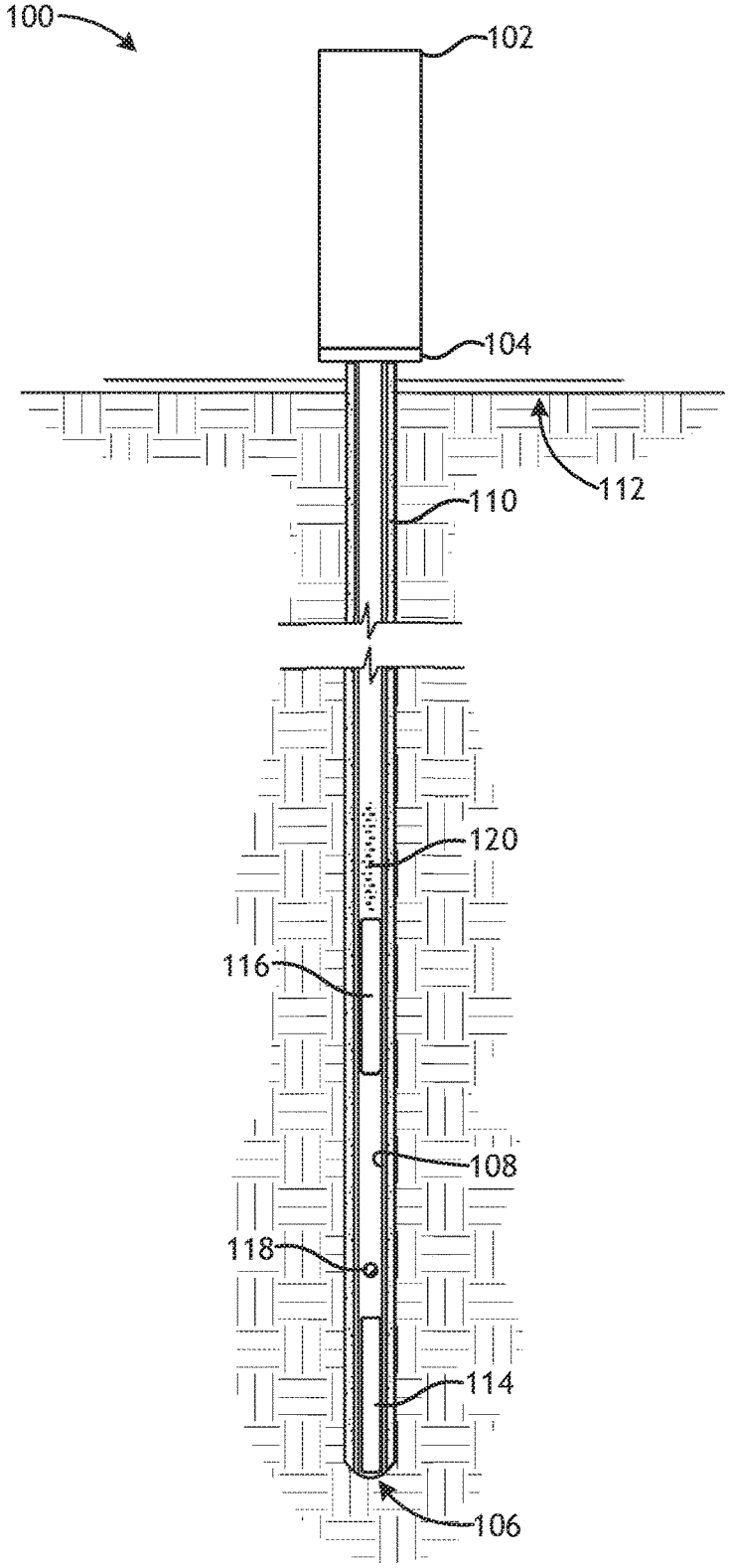
FIG. 1 is a schematic diagram illustrating one embodiment of a system having a well plunger.

FIG. 1 is a schematic diagram illustrating one embodiment of a system 100 having a plunger lift lubricator 102. In the depicted embodiment, the system 100 includes a well assembly having a well bottom 106 and a wellhead 104 coupled together by well pipe 108. The well pipe 108 may be inserted into a hole formed by the well casing 110. Well casing 110 may be formed in the ground 112 with concrete or other structurally adequate materials. The well pipe 108 and well casing 110 may be of varying length since not all wells are drilled to the same depth. In some embodiments, the well may be a vertical well as shown. In other embodiments, the well may be a horizontal well configuration, or a hybrid well configuration, as is recognized by one of ordinary skill in the art.

The system 100 may include a bumper assembly 114 proximate to the well bottom 106. In an embodiment, the plunger 116 may be configured to lift fluid 120 from the well bottom 106 to the wellhead 104. The fluid 120 is received by the lubricator 102 and expelled through one or more ports to peripheral components (not shown). In an embodiment, the plunger 116 may engage with a stopper, such as the stopper ball 118. In some embodiments, the stopper ball 118 may be a steel sphere configured to be received by a portion of the plunger 116. The stopper may restrict flow of fluid and/or gas through or around the plunger 116, thereby causing the plunger to rise to the lubricator 102. The lubricator 102 may cause the stopper 118 to be released, thereby allowing passage of fluids through or around the plunger 116, and causing the plunger 116 to fall back to the bumper 114. The bumper 114 may dampen the impact forces when the plunger 116 approaches the bottom of the well 106. The stopper 118 may be received by the plunger 116 again, and the process may repeat, thereby cyclically lifting fluid 120 to be expelled by the lubricator 102.

Figure 2:
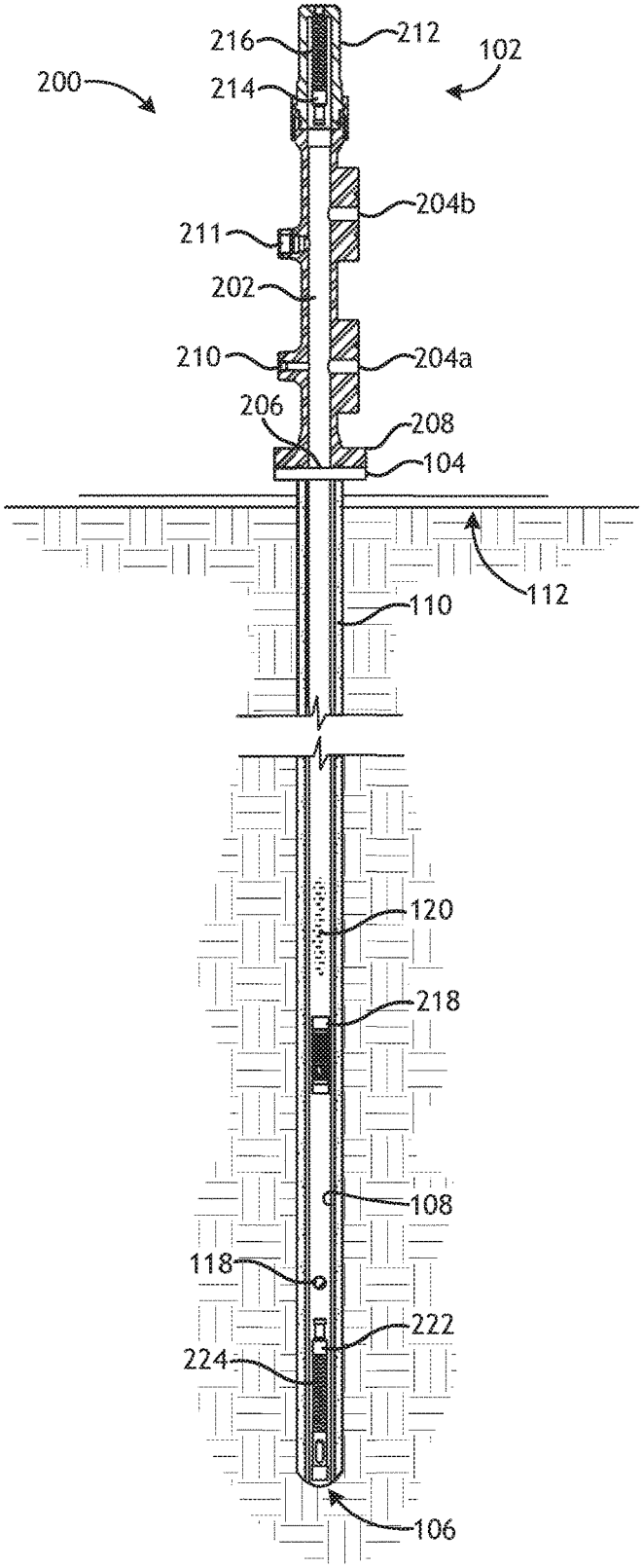
FIG. 2 is a schematic diagram illustrating one embodiment of a system having a well plunger.

FIG. 2 is a schematic diagram illustrating one embodiment of a system 200 having a lubricator 102. As in the embodiment of FIG. 1, the well may include a well bottom 106 and a wellhead 104 separated by a well pipe 108 and a well casing 110 formed in the ground 112. In the depicted embodiment, the lubricator 102 may include a main body 202. The lubricator 102 may also include a plurality of fluid conduit ports 204*a-b*, one or more sensor access port(s) 210, and a catcher port 211 configured to receive a catcher assembly for catching the plunger 218. Additionally, the lubricator 102 may include an inlet port 206 having an inlet flange 208 for coupling the lubricator 102 to the wellhead 104.

In an embodiment, the system may include a plunger 218. The plunger 218 may be a ball and sleeve plunger in some embodiments. The plunger 218 may include an assembly of parts, including a retention assembly for retaining the stopper 118, which may be a ball in some embodiments, within a portion of the body of the plunger assembly 218 during use. The stopper 118 may be ejected from the plunger 218 by components of the lubricator 102 in some embodiments. When both the stopper 118 and the plunger 218 collide at the well bottom 106, the stopper 118 may be retained within the portion of the plunger 218 again, until the plunger 218 reaches the lubricator 102 where the stopper 118 is once again ejected from the plunger 218. This process may repeat continuously, or nearly continuously, in some embodiments.

In an embodiment, the bumper 222 may include a progressive rate spring 224. One example of a bumper 222 which may be suitable for use with the present embodiments is described in U.S. patent application Ser. No. 14/333,058 entitled "Bumper Assembly Having Progressive Rate Spring," filed on Jul. 16, 2014, which is incorporated herein by reference in its entirety. Although the progressive rate bumper 224 is one embodiment of a bumper 114 that may be included with the present embodiments, one of ordinary skill will recognize alternative embodiments of bumpers 114 which may be equally suitable depending on the applicable well conditions.

In the embodiment of FIG. 2, the lubricator 102 may include a spring assembly 214, which may further include a catch spring 216 disposed in a spring housing 212. In an embodiment, the catch spring 216 may also be a progressive rate spring, as described in relation to the bumper spring assembly. Alternatively, the catch spring 216 may be a common constant rate spring. One of ordinary skill will recognize various embodiments of a spring/catch assembly which may be used in conjunction with the present embodiments of the lubricator 102 depending on the applicable well conditions. The spring assembly 214 may work in conjunction with the catch assembly (not shown), which is received by the catch port 211. The catch assembly may include a flange or lever for locking the plunger 218 in place, or for releasing the plunger 218 back into the well.

Figure 3:
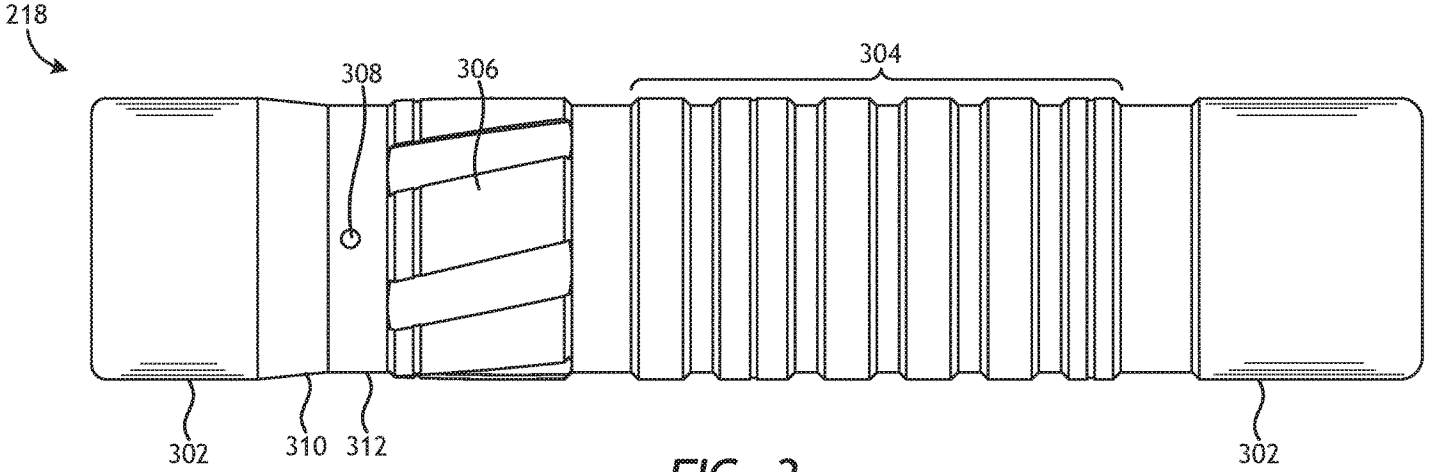
FIG. 3 is a side view diagram illustrating one embodiment of a well plunger.

FIG. 3 is a side view diagram illustrating one embodiment of a plunger 218. In an embodiment, the plunger 218 may include a main body 302. The main body 302 may be sized to fit within an internal diameter of a well pipe 108. In some embodiments, the plunger 218 may be sized such that a margin of space suitable to the application (as will be appreciated by a person of ordinary skill in the art) is provided between the inner surface of the well pipe 108 and the sides of the main body 302.

In an embodiment, the main body 302 may include one or more turbulence inducing features 304 configured to interact with fluid passing over the surface of the main body 302. The turbulence inducing features 304 may be spaced apart according to a pattern calculated to affect the rate of fluid flow over the surface of the main body 302 when the plunger is in operation within the well pipe 108. In such an embodiment, the turbulence inducing features 304 also may affect the rate of decent of the plunger from the wellhead 104 to the well bottom 106.

Additionally, the plunger 218 may include one or more rifling features 306 configured to cause the plunger 218 to rotate within the well pipe 108 during decent and/or ascent. Such an embodiment is intended to cause more uniform wear on the outer diameter of the plunger 218, particularly when the plunger 218 is deployed in a deviated well system.

In one embodiment, the plunger 218 may include one or more features for clearing debris during use. For example, in an embodiment, the main body 302 may include a taper region 310 configured to taper from the outer diameter of the main body to a recess region 312. In an embodiment, a port 308 may be disposed at or near the recess region 312. In such an embodiment, fluid may flow through the port 308 and clear debris from the inner surface of the main body 302, thereby reducing clogging of debris within the main body 302.

Figure 4:
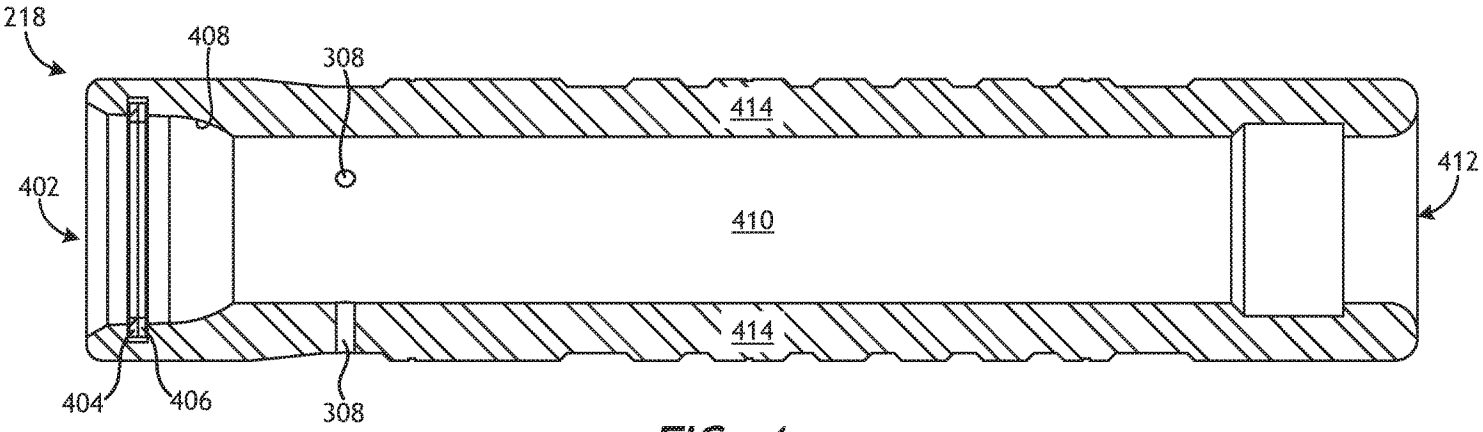
FIG. 4 is a cross-section view diagram illustrating one embodiment of a well plunger.

FIG. 4 is a cross-section view diagram illustrating one embodiment of the plunger 218 of FIG. 3. In an embodiment, the main body 302 comprises sidewalls 414 having an open channel 410 for allowing fluid to pass from a first open end 402 to a second open end 412. One or more ports 308 may extend from the inner surface of the channel 410 to the outer surface of the main body 302.

In an embodiment, the first end 402 may include a receiver 408 for receiving the stopper ball 118. In such an embodiment, the receiver 408 may include a curved surface configured to receive at least a portion of the same or similarly curved surface of the stopper ball 118. Additionally, a retention mechanism may be disposed at or near the first end 402 for retaining the stopper ball 118 within the receiver 408 as shown in further detail in FIGS. 8-9. In one embodiment, the retention mechanism may comprise a first c-ring. In a further embodiment, the retention mechanism may include a second (or more) c-ring(s). The c-rings 404-406 may be c-shaped rings of spring metal, or other resilient material. The c-rings 404-406 may be configured to be expanded or displaced when receiving the stopper ball 118, thereby applying a friction or retention force to the stopper ball 118. The friction or retention force may be less than an ejection force applied by the lubricator, which causes the stopper ball 118 to be ejected from the receiver 408.

During operation, fluid in the well may pass through the channel 410 while the plunger 218 is descending to the well bottom 106. Upon reaching the well bottom 106, the plunger 218 collides with the stopper ball 118, which blocks the flow path through the channel 410. When the channel 410 is blocked, fluid and debris above the plunger is pushed by the closed plunger to the wellhead 104 and out of the well through the lubricator 102. The lubricator ejects the stopper ball 118 from the plunger 218, and the process cycles. One of ordinary skill will recognize that various sizes and shapes of plungers and stoppers may be suitable for use with the present embodiments. For example, the stopper may be bullet shaped, egg shaped, or the like. Alternatively, complex stopper geometries may be used for various fluid dynamics benefits, and for various retention or interface characteristics with the plunger 218. Accordingly, the shape or dimensions of the plunger 218 may be varied based on use conditions and/or in response to the geometry of the stopper.

Figure 5:
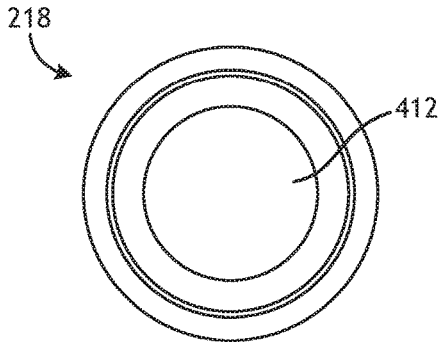
FIG. 5 is an end view diagram illustrating a second end of an embodiment of a well plunger.
Figure 6:
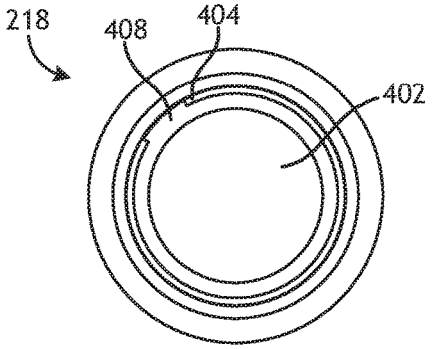
FIG. 6 is an end view diagram illustrating a first end of an embodiment of a well plunger.

FIG. 5 is an end view diagram illustrating a second end of an embodiment of the plunger 218. In the embodiment, the second end 412 may include an opening for allowing fluid to pass through the channel 410. Additionally, the second end 412 may receive an ejector rod at the lubricator 102, the ejector rod configured to pass through the chamber 410 and strike the stopper ball 118, thereby ejecting the ball from the receiver 408. FIG. 6 is an end view diagram illustrating a first end of an embodiment of the plunger 218. The first end 402 includes an opening. The opening may allow the stopper ball 118 to pass into the receiver 408. The retention mechanism may include a first c-ring configured to retain the ball 218 proximate the receiver 408 until the ball is ejected by the lubricator 102.

Figure 7:
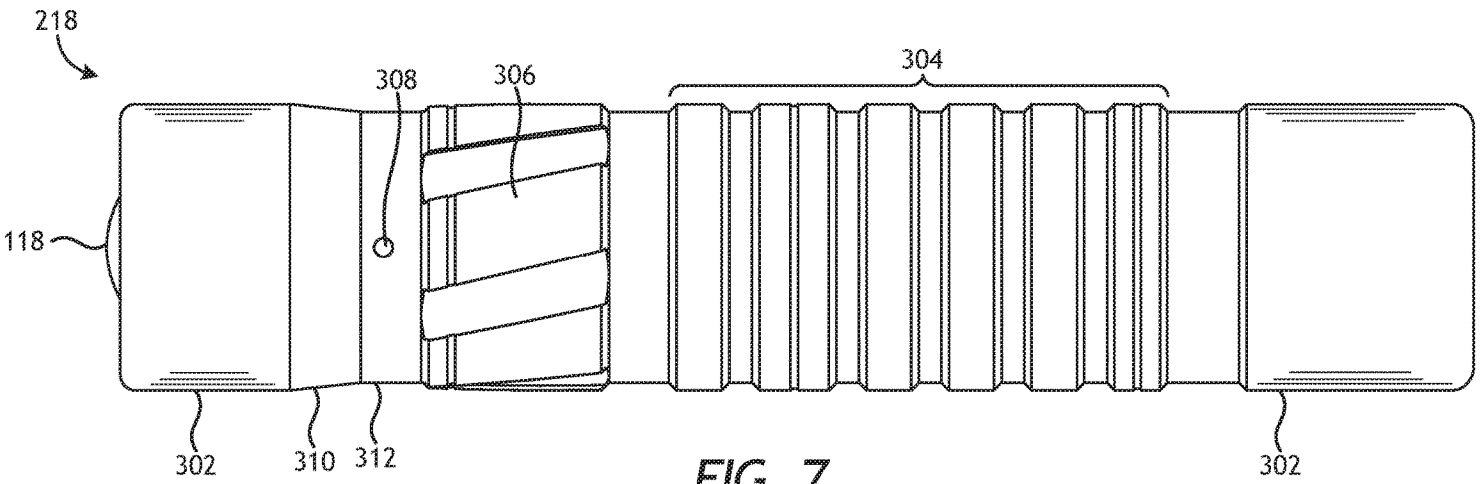
FIG. 7 is a side view diagram illustrating an embodiment of a shuttle ball plunger system.
Figure 8:
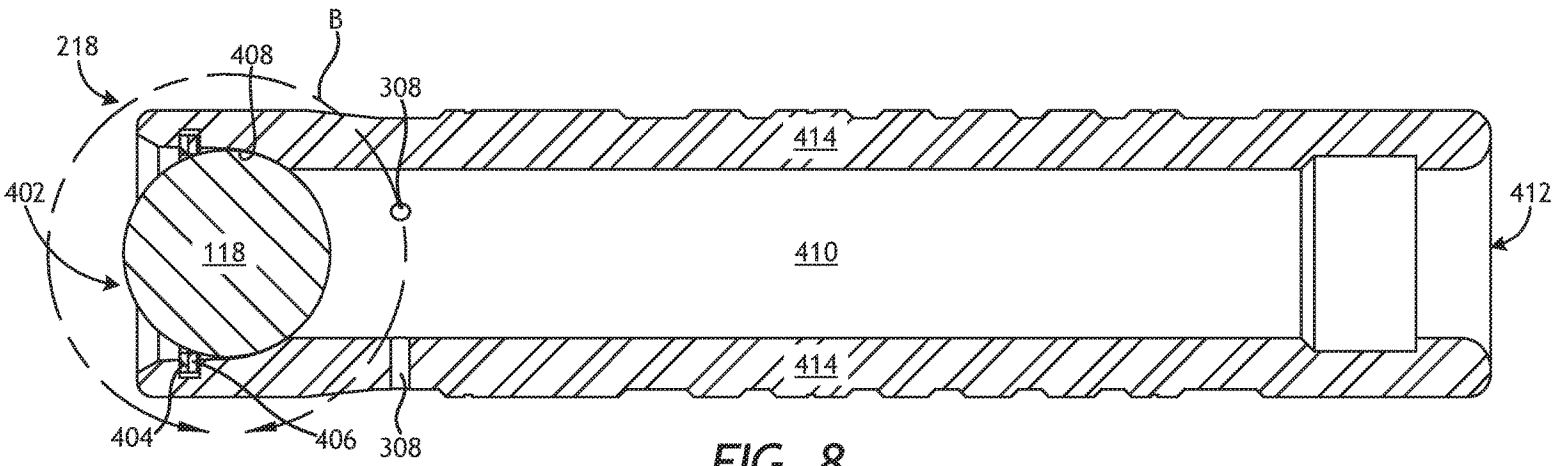
FIG. 8 is a cross-section view diagram illustrating one embodiment of a shuttle ball plunger system.
Figure 9:
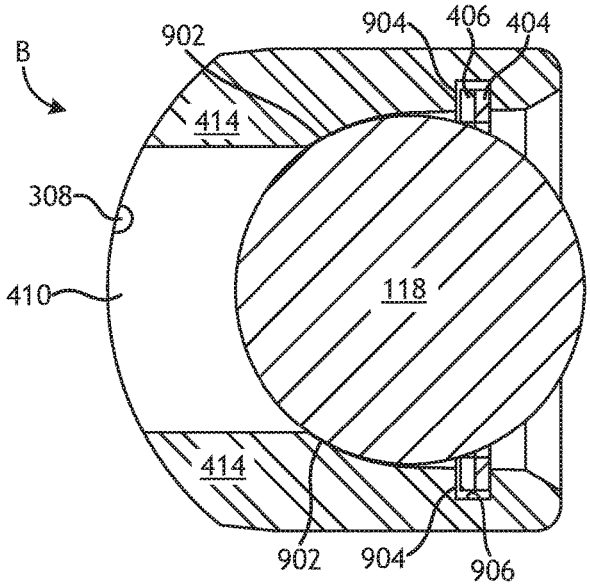
FIG. 9 is a detailed view of a portion of the shuttle ball plunger system of FIG. 8.

FIGS. 7-9 illustrate interactions between the stopper ball 118 and the plunger 218. FIG. 7 is a side view diagram illustrating an embodiment of a shuttle ball plunger system. As illustrated, the stopper ball 118 may be received by the first end 402. FIG. 8 is a cross-section view diagram illustrating one embodiment of a shuttle ball plunger system. In an embodiment, the stopper ball 118 is received by the receiver 408. In one embodiment (not shown in FIG. 8), the contour of the receiver 408 may be slightly mismatched with the contour of the stopper ball 118. In such an embodiment, the mismatch may provide slight spaces between the otherwise more perfect mating surface of the receiver 408 and the otherwise more perfect mating surface of the stopper ball 118, except for one or more contacts points between the receiver 408 and the stopper ball 118. The space provided may allow for displacement of debris, thereby preventing jamming or lodging of the stopper ball 118 within the receiver 408, or preventing debris from keeping the stopper ball 118 from properly seating within the receiver 408. It should also be noted that when stopper ball 118 is seated in position with respect to receiver 408, the one or more retention mechanisms 404, 406 may or may not be under constant compressive force (due to the stopper ball 118 being (or not being) lodged within the inside surface of the retention mechanism), although it is preferred that they not be lodged since that preferred embodiment will lead to a longer useful life of the retention mechanism. In other words, while retention mechanisms 404, 406 retain stopper ball 118 in position with respect to receiver 408, it is preferred that stopper ball 118 and receiver 408 have geometries that allow receiver ball 118 to fully pass retention mechanisms 404, 406 before coming to rest within receiver 408.

In an embodiment, fluid and debris may pass from the channel 410 through the port(s) 308. In such an embodiment, the channel 410 may remain relatively clear of debris during ascent, thereby avoiding clogging or blockage of the channel 410. In such an embodiment, the channel 410 may be better capable of receiving the ejector rod of the lubricator 102.

Figure 10:
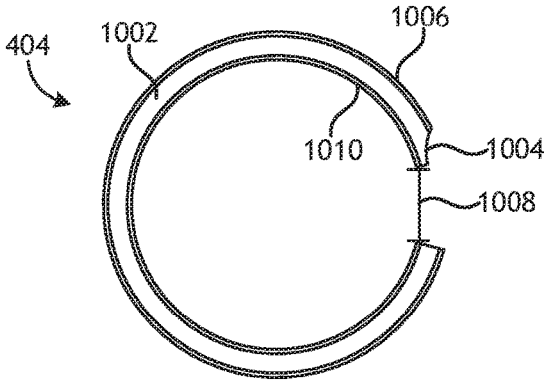
FIG. 10 is a side view diagram illustrating one embodiment of a retention member for a plunger assembly.
Figure 11:
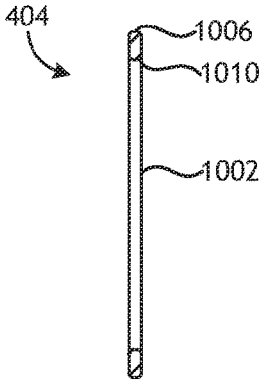
FIG. 11 is a cross-section view diagram illustrating one embodiment of a retention member for a plunger assembly.
Figure 12:
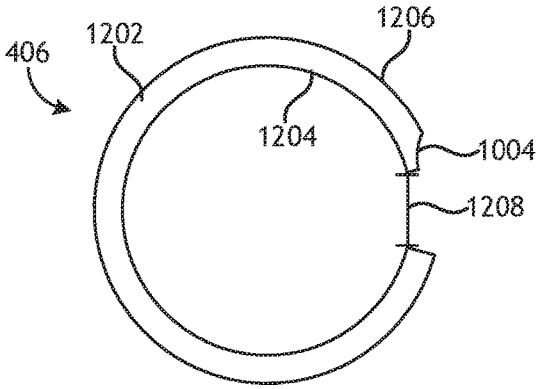
FIG. 12 is a side view diagram illustrating one embodiment of a retention member for a plunger assembly.
Figure 13:
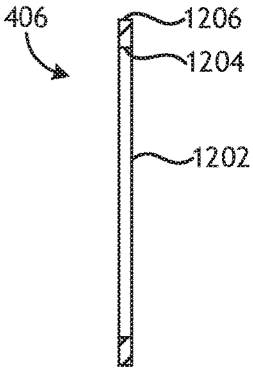
FIG. 13 is a cross-section view diagram illustrating one embodiment of a retention member for a plunger assembly.

FIG. 9 is a detailed view of a portion associated with the callout 'B' portion of the shuttle ball plunger system of FIG. 8. In an embodiment, the sidewalls 414 at the first open end may include a retention member receiver 904 for receiving the retention mechanism. For example, the retention member receiver 904 may include a slot configured to receive one or more c-rings 404, 406. In a particular embodiment, the retention member receiver 904 may be configured to receive a first retention member 404 and a second retention member 406. In a further embodiment, the retention member 404, 406 may include a first c-ring having flat inside and outside edges, as illustrated in FIGS. 12-13 at edges 1204 and 1206, respectively. In another embodiment, the retention member 404, 406 may include a second c-ring having rounded (i.e., radiused) inside and outside edges, as illustrated in FIGS. 10-11 at edges 1010 and 1006, respectively. Alternative embodiments may exist, including embodiments where one or both c-rings 404, 406 have flat edges, or where one or both c-rings 404-406 have radiused edges, or where the inside and outside edges of each c-ring are the same or different. A preferred embodiment is one in which the c-ring(s) have radiused inside edges. In the described embodiments, the retention member receiver 904 may be sized with a gap 906 to allow for expansion of the retention members 404-406 within the receiver when the stopper ball 118 passes through the retention members.

FIG. 10 is a side view diagram illustrating one embodiment of a retention member for a plunger assembly. In an embodiment, the retention member is a first c-ring. The first c-ring may include a ring-shaped body 1002. The ring-shaped body 1002 includes a cut-out portion 1008, thereby creating a 'C' shaped structure, referred to herein as a "c-ring." The cut-out portion 1008 allows expansion of the ring-shaped body 1002 when the retention member receives the stopper ball 118. As indicated above, the first c-ring may be retained within retention member receiver 904. In a further embodiment, a notch 1004 may facilitate insertion and/or removal of the c-ring into and/or from the retention member receiver 904 during assembly of the plunger 218.

The first c-ring also includes an inside edge 1010 configured to apply a retention force to the stopper ball 118 when engaged with the stopper ball. Additionally, the first c-ring includes an outside edge 1006 configured to be captured within the retention member receiver 904. As described above in connection with FIGS. 10-11, at least one of the inside edge 1010 and/or the outside edge 1006 is rounded. Alternative configurations may exist, however, such as alternative edge geometries, including bevels, triangular edges, elliptical edges, trapezoidal edges, etc. In particular, one edge may be rounded or beveled for receiving the stopper ball 118, while the other edge may be shaped to match an edge of a second c-ring or the back side of retention member receiver 904. The inside edge 1010 does not necessarily need to match the outside edge 1006. For example, the inside edge 1010 may be rounded, while the outside edge 1006 may be rectangular, etc. Preferably, however, the inside edge is rounded (or radiused) and the outside edge is flat.

FIG. 12 is a side view diagram illustrating one embodiment of a second retention member 406 for a plunger assembly. The second retention member 406 may be similar to the first retention member 404. For example, the second retention member 406 may be a second c-ring. In such an embodiment, the second c-ring may include a body 1202 having an inside edge 1204 and an outside edge 1206. The c-ring also includes a cut-out 1208 from the body 1202 for allowing expansion or compression of the body 1202. As illustrated in FIG. 13, the second c-ring may have a substantially rectangular cross-section, having a flat inside edge 1204 and a flat outside edge 1206. As with the first c-ring, the second c-ring may have inside and outside edges of alternative geometries.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. An apparatus for removing liquids from a well, comprising:

a body having a first open end, a second open end, and a channel extending from the first open end through the body to the second open end;

a receiver disposed at the first open end, the receiver configured to receive a stopper through the first open end and to at least partially seal off the channel to enable the apparatus to remove liquids from the well, the first open end including a retention member receiver configured to receive a c-ring for applying a retention force to the stopper when the stopper is engaged with the receiver, wherein the stopper is maintained in place in the receiver by the c-ring applying the retention force to the stopper when the stopper is engaged with the receiver; and the c-ring having an inside edge and an outside edge, wherein the inside edge imparts the retention force to the stopper.

2. The apparatus of claim 1, wherein the receiver has an upper surface contour for engaging an upper surface contour of the stopper, where the upper surface contour of the receiver only partially matches the upper surface contour of the stopper.

3. The apparatus of claim 2 wherein the c-ring includes a cut-out for allowing the c-ring to expand or contract.

4. The apparatus of claim 3 wherein the stopper and the c-ring have relative sizes such that the stopper will pass through the c-ring when the c-ring is expanded.

5. The apparatus of claim 4 wherein the stopper and the c-ring have relative sizes such that the stopper will not pass through the c-ring when the c-ring is contracted.

6. The apparatus of claim 5 wherein the stopper is maintained in place in the receiver by the c-ring when the c-ring is contracted.

7. The apparatus of claim 6, further comprising a port disposed through a sidewall of the body and into the channel for allowing fluid to flow between the channel and an outside of the body when the stopper is maintained in place in the receiver by the c-ring.

8. The apparatus of claim 1, further comprising a port disposed through a sidewall of the body and into the channel for allowing fluid to flow between the channel and an outside of the body when the stopper is maintained in place in the receiver by the c-ring.

9. The apparatus of claim 1 wherein the inside edge of the c-ring is radiused.

10. An apparatus, comprising:

a body having a first open end, a second open end, and a channel extending from the first open end through the body to the second open end;

a receiver disposed at the first open end, the receiver configured to receive a stopper configured to at least partially seal off the channel, the first open end including a retention member receiver configured to receive a c-ring for applying a retention force to the stopper when the stopper is engaged with the receiver, wherein the stopper is maintained in place in the receiver by the c-ring applying the retention force to the stopper when the stopper is engaged with the receiver;

the receiver further including an upper surface contour for engaging an upper surface contour of the stopper, where the upper surface contour of the receiver only partially matches the upper surface contour of the stopper; and the c-ring having an inside edge and an outside edge, wherein the inside edge imparts the retention force to the stopper.

11. The apparatus of claim 10 wherein the c-ring includes a cut-out for allowing the c-ring to expand or contract.

12. The apparatus of claim 11 wherein the stopper and the c-ring have relative sizes such that the stopper will pass through the c-ring when the c-ring is expanded.

13. The apparatus of claim 12 wherein the stopper and the c-ring have relative sizes such that the stopper will not pass through the c-ring when the c-ring is contracted.

14. The apparatus of claim 13 wherein the stopper is maintained in place in the receiver by the c-ring when the c-ring is contracted.

15. An apparatus for removing liquids from a well, comprising:

a body having a first open end, a second open end, and a channel extending from the first open end through the body to the second open end;

a receiver disposed at the first open end, the receiver configured to receive a stopper through the first open end and to at least partially seal off the channel to enable the apparatus to remove liquids from the well, the first open end including a retention member receiver configured to receive a c-ring for applying a retention force to the stopper when the stopper is engaged with the receiver, wherein the stopper is maintained in place in the receiver by the c-ring applying the retention force to the stopper when the stopper is engaged with the receiver;

the c-ring having an inside edge and an outside edge, wherein the inside edge imparts the retention force to the stopper; and the c-ring having a cut-out for allowing the c-ring to expand or contract.

16. The apparatus of claim 15 wherein the stopper and the c-ring have relative sizes such that the stopper will pass through the c-ring when the c-ring is expanded.

17. The apparatus of claim 16 wherein the stopper and the c-ring have relative sizes such that the stopper will not pass through the c-ring when the c-ring is contracted.

18. The apparatus of claim 17 wherein the stopper is maintained in place in the receiver by the c-ring when the c-ring is contracted.

19. The apparatus of claim 18, wherein the receiver has an upper surface contour for engaging an upper surface contour of the stopper, where the upper surface contour of the receiver only partially matches the upper surface contour of the stopper.

20. The apparatus of claim 19, further comprising a port disposed through a sidewall of the body and into the channel for allowing fluid to flow between the channel and an outside of the body when the stopper is maintained in place in the receiver by the c-ring.

* * * * *